US007757521B2

(12) United States Patent
Hong

(10) Patent No.: US 7,757,521 B2
(45) Date of Patent: Jul. 20, 2010

(54) WASHING AND DRYING MACHINE

(75) Inventor: Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 835 days.

(21) Appl. No.: 11/397,676

(22) Filed: Apr. 5, 2006

(65) Prior Publication Data

US 2006/0225468 A1 Oct. 12, 2006

(30) Foreign Application Priority Data

Apr. 6, 2005 (KR) ..... 10-2005-0028482

(51) Int. Cl.
*D06F 25/00* (2006.01)

(52) U.S. Cl. ..... 68/20

(58) Field of Classification Search ..... 68/19.2, 68/20; 34/77

See application file for complete search history.

(56) References Cited

U.S. PATENT DOCUMENTS

| | | | | |
|---|---|---|---|---|
| 2,644,245 | A * | 7/1953 | Hammell et al. | 34/547 |
| 3,006,176 | A * | 10/1961 | Behrens | 68/12.01 |
| 4,112,590 | A * | 9/1978 | Muller | 34/75 |
| 4,154,003 | A * | 5/1979 | Muller | 34/469 |
| 5,802,884 | A * | 9/1998 | Cavalli | 68/18 C |
| 6,665,953 | B2 * | 12/2003 | Woo et al. | 34/527 |
| 2004/0221474 | A1 * | 11/2004 | Slutsky et al. | 34/319 |
| 2005/0252030 | A1 | 11/2005 | Park et al. | |

FOREIGN PATENT DOCUMENTS

| | | |
|---|---|---|
| FR | 2279878 | 2/1976 |
| FR | 2465824 | 3/1981 |
| JP | 6-063296 | 3/1994 |
| KR | 8-229298 | 9/1996 |
| KR | 9-056967 | 3/1997 |

OTHER PUBLICATIONS

Electronic translation of FR 2279878.*
Electronic translation of FR 2465824.*
U.S. Appl. No. 11/397,675 to Hee Tae Lim et al., filed Apr. 5, 2006.
English Language Abstract of KR 9-056967.
English Language Abstract of KR 8-229298.
English language Abstract of JP 6-063296.

* cited by examiner

*Primary Examiner*—Joseph L Perrin
(74) *Attorney, Agent, or Firm*—Birch, Stewart, Kolasch & Birch, LLP

(57) ABSTRACT

A washing and drying machine includes a drying duct having at least one inlet end and at least two outlet ends. Consequently, air flow is increased, and drying time and power consumption are reduced. The inlet end is connected to the center portion of the circumferential surface of a tub, and the outlet ends include a front outlet end connected to the front side of the tub and a rear outlet end connected to the rear side of the tub. Consequently, the laundry is uniformly dried even when the laundry is placed in the drum at the front and/or the rear sides of the drum, and therefore, damage to the laundry is prevented. Flow resistance is minimized, and drying time and power consumption are reduced.

14 Claims, 6 Drawing Sheets

WASHING AND DRYING MACHINE

CROSS REFERENCE TO RELATED APPLICATIONS

The present disclosure relates to subject matter contained in priority Korean Application No. 28482, filed on Apr. 6, 2005, which is herein expressly incorporated by reference in its entirety.

BACKGROUND OF THE INVENTION

1. Field of the Invention

The present invention relates to a washing and drying machine, and, more particularly, to a washing and drying machine wherein the length of a drying duct is decreased to reduce flow resistance, and the drying duct has a plurality of inlet and outlet ends to uniformly dry laundry in a drum, whereby drying time and power consumption are greatly reduced.

2. Description of the Related Art

Generally, a washing machine is a machine that is capable of removing pollutants from clothes or bedclothes (hereinafter, referred to as "laundry") with detergent-dissolved water or pure water (hereinafter, referred to as "washing water"). Recently, a large number of washing machines have incorporated a drying unit for drying the laundry, and therefore, each washing machine has a drying function.

FIG. 1 is a longitudinal sectional view illustrating the interior of a conventional washing and drying machine.

As shown in FIG. 1, the conventional washing and drying machine comprises: a cabinet 2 forming the exterior of the washing machine; a tub 10 mounted in the cabinet 2 for receiving washing water; a drum 20 rotatably disposed in the tub 10 for receiving laundry 1; and a motor 30 for rotating the drum 20.

At the front surface of the cabinet 2 is formed a laundry inlet/outlet hole 3, through which the laundry 1 is put into the drum 20 and removed from the drum 20. The laundry inlet/outlet hole 3 is opened or closed by a door 4.

The tub 10 is mounted in the cabinet while being suspended by springs 5 connected between the upper end of the cabinet 2 and the tub 10. Also, the tub 10 is supported by a damper 6 disposed at the lower end of the cabinet 2 such that shock applied to the tub 10 is effectively absorbed by the damper 6.

To the tub 10 is connected a water supply unit 7 for supplying washing water into the tub 10 from the outside of the washing machine. To the tub 10 is also connected a drainage unit 8 for draining the washing water out of the tub 10.

At the center part of the front surface of the tub 10 is formed a tub opening hole 11, through which the laundry 1 and air are introduced into or discharged from the tub 10. To the front surface of the tub 10 is attached a gasket 9, which comes into tight contact with the door 4, when the door 4 is closed, for preventing the laundry 1, the washing water, and the air from being discharged from a gap between the tub 10 and the door 4.

At the inner bottom surface of the tub 10 is mounted a washing heater 13 for heating the washing water such that the laundry can be washed with hot water. At the inner bottom surface of the tub 10 is also mounted a washing temperature sensor (not shown) for detecting the temperature of the washing water.

At the front surface of the drum 20 is formed a drum opening hole 21, through which the laundry 1 and air are introduced into or discharged from the drum 20. At the circumferential surface of the drum 20 are formed a plurality of through-holes 22, through which washing water and air are introduced into or discharged from the drum 20.

To the inner wall of the drum 20 are attached lifters 23, by which the laundry 1 is lifted and then falls.

The washing and drying machine further includes: a drying duct 40, having a blowing fan 41 and a drying heater 42 mounted therein, for supplying hot air into the drum 20; and a condenser 43 for condensing wet air generated when the drum 20 is dried and guiding the condensed air to the drying duct 40.

In the drying duct 40 is mounted a fan motor 44 for rotating the blowing fan 41. The outlet end of the drying duct 40 is fixedly inserted into or fitted onto a drying duct connection member 12, which is formed at the gasket 9.

The condenser 43 comprises: a condensing duct 45 connected to the rear part of the tub 10 for allowing air to pass therethrough; and a cooling water supply unit 46 for supplying cooling water into the condensing duct 45 such that the air passing through the condensing duct 45 is cooled by the cooling water and thus condensed.

The inlet end of the condensing duct 45 is diagonally opposite to the outlet end of the drying duct 40 such that dry air introduced into the tub 10 from the drying duct 40 is uniformly circulated in the tub 10, and is then discharged into the condensing duct 45.

Specifically, the outlet end of the drying duct 40 is connected to the front upper part of the tub 10 while the inlet end of the condensing duct 45 is connected to the rear lower part of the tub 10.

In the condensing duct 45 is mounted a condenser temperature sensor 47 for detecting the temperature of air cooled by the cooling water.

The operation of the conventional washing and drying machine with the above-stated construction will now be described.

When a user puts the laundry 1 into the drum 20, closes the door 4, and operates the washing machine, washing water is introduced into the cabinet 2 through the water supply unit 7.

The introduced washing water is supplied into the tub 10, and is then introduced into the drum 20 through the drum opening hole 21 or the through-holes 22 such that the laundry 1 is wetted by the washing water.

As the motor 30 is operated, the drum 20 is rotated, and as a result, pollutants are separated from the laundry 1 by the washing water.

After the above-described washing process is completed, the pollutant contaminated washing water is drained out of the tub 10 through the drainage unit 8. Subsequently, a rinsing process for rinsing bubbles from the laundry 1 is performed several times.

After the rinsing processes are completed, a water moving or spinning process is performed to remove moisture from the laundry 1 by centrifugal force.

Subsequently, a drying process for drying the laundry 1 is performed. The drum 20 is rotated by the motor 30, and the blowing fan 41 and the drying heater 42 are turned on. Also, the cooling water is supplied into the condensing duct 45 through the cooling water supply unit 46.

As the blowing fan 41 is rotated, low-temperature and high-humidity air in the drum 20 is introduced into the condensing duct 45 through the through-holes 22 of the drum 20 and the tub 10.

At this time, the cooling water supplied through the cooling water supply unit 46 falls into the condensing duct 45, and moisture in the air introduced into the condensing duct 45 is condensed by the cooling water. As a result, the air is dried.

After the air passes through the condensing duct 45, the air passes through the drying duct 40. At this time, the air is heated by the drying heater 42, and as a result, the air is changed into hot air. The hot air is blown to the front surface of the drum 20 through the outlet end of the drying duct 40.

The laundry 1 is dried in the drum 20 by the blown hot air, and as a result, the hot air is changed into low-temperature and high-humidity air, which flows into the condensing duct 45.

In the conventional washing and drying machine with the above-stated construction, however, the outlet end of the drying duct 40 is diagonally opposite to the inlet end of the condensing duct 45 such that the hot air is uniformly circulated in the drum 20. As a result, the length of the drying duct 40 and the condensing duct 45 is relatively increased. Consequently, flow resistance is increased, and therefore, it is difficult to obtain a sufficient air flow. Furthermore, drying time and power consumption are increased.

In addition, the capacities of the tub 10 and the drum 20 are relatively decreased due to the increased length of the condensing duct 45.

In order to solve the above-mentioned problems, the inlet end of the condensing duct 45 may be disposed at the side surface of the tub 10. In this case, the length of the condensing duct 45 is decreased. However, hot air is supplied only to the front part of the drum 20, and therefore, the laundry 1 placed in the rear part of the drum 20 is not sufficiently dried. Consequently, the laundry 1 is not uniformly dried in the drum 20, and therefore, drying time and power consumption are increased, and the laundry 1 may be damaged.

SUMMARY OF THE INVENTION

The present invention is provided in view of the above problems, and it is an object of the present invention to provide a washing and drying machine that is capable of uniformly drying laundry in a drum and minimizing flow resistance, thereby reducing drying time and power consumption.

In accordance with the present invention, the above and other objects can be accomplished by the provision of a washing and drying machine including a tub disposed in a cabinet in a supported manner; a drum rotatably provided inside the tub; and a drying duct, having a drying heater and a blowing fan mounted therein, for supplying hot air into the drum, wherein the drying duct is provided with at least two outlet ends for discharging the hot air into the drum.

Preferably, the drying duct is provided with at least one inlet end for introducing air from the drum, the at least one inlet end being connected to the circumferential surface of the tub.

Preferably, the at least two outlet ends include a front outlet end connected to the front side of the tub for discharging the hot air into the tub at the front side of the tub; and a rear outlet end connected to the rear side of the tub for discharging the hot air into the tub at the rear side of the tub.

Preferably, the front outlet end is connected to the upper part of the front surface of the tub.

Preferably, the washing and drying machine further includes a door for opening or closing a laundry inlet/outlet hole formed at the cabinet; and a gasket attached to the tub for maintaining the seal between the door and the tub, wherein the front outlet end is connected to the gasket.

Preferably, the rear outlet end is connected to the rear part of the upper side of the tub.

Preferably, the rear outlet end is connected to the upper part of the rear surface of the tub.

Preferably, the washing and drying machine further includes a blocking wall disposed between the tub and the drum for preventing the hot air discharged through the at least two outlet ends from flowing between the circumferential surface of the tub and the circumferential surface of the drum.

Preferably, the washing and drying machine further includes a condenser to condense moisture in the air in the tub.

Preferably, the condenser includes a cooling water supply unit for supplying cooling water to one side of the tub; and a condensing plate mounted at the inner wall of the tub for guiding the cooling water supplied from the cooling water supply unit such that the cooling water flows between the inner wall of the tub and the condensing plate.

According to the present invention, the drying duct has at least one inlet end and at least two outlet ends. Consequently, air flow is increased, and therefore, drying time and power consumption are reduced.

Furthermore, the inlet end is connected to the center part of the circumferential surface of the tub, and the outlet ends include a front outlet end connected to the front side of the tub and a rear outlet end connected to the rear side of the tub. Consequently, the laundry is uniformly dried even when the laundry is placed in the drum at the front and/or the rear sides of the drum, and therefore, damage to the laundry is prevented. Also, air flow sufficient to dry the laundry is obtained, and flow resistance is minimized. Consequently, drying time and power consumption are reduced.

In addition, the blocking wall is provided between the tub and the drum for preventing hot air discharged through the rear outlet end from flowing between the inner circumferential surface of the tub and the outer circumferential surface of the drum. Consequently, effective flow rate of the hot air discharged into the drum is increased.

Moreover, the front outlet end is directly connected to the upper part of the front surface of the tub. As a result, the hot air does not pass through the gasket. Consequently, damage to the gasket is prevented, and therefore, decrease in service life of the gasket is prevented.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Now, preferred embodiments of the present invention will be described in detail with reference to the accompanying drawings.

Figure 1:
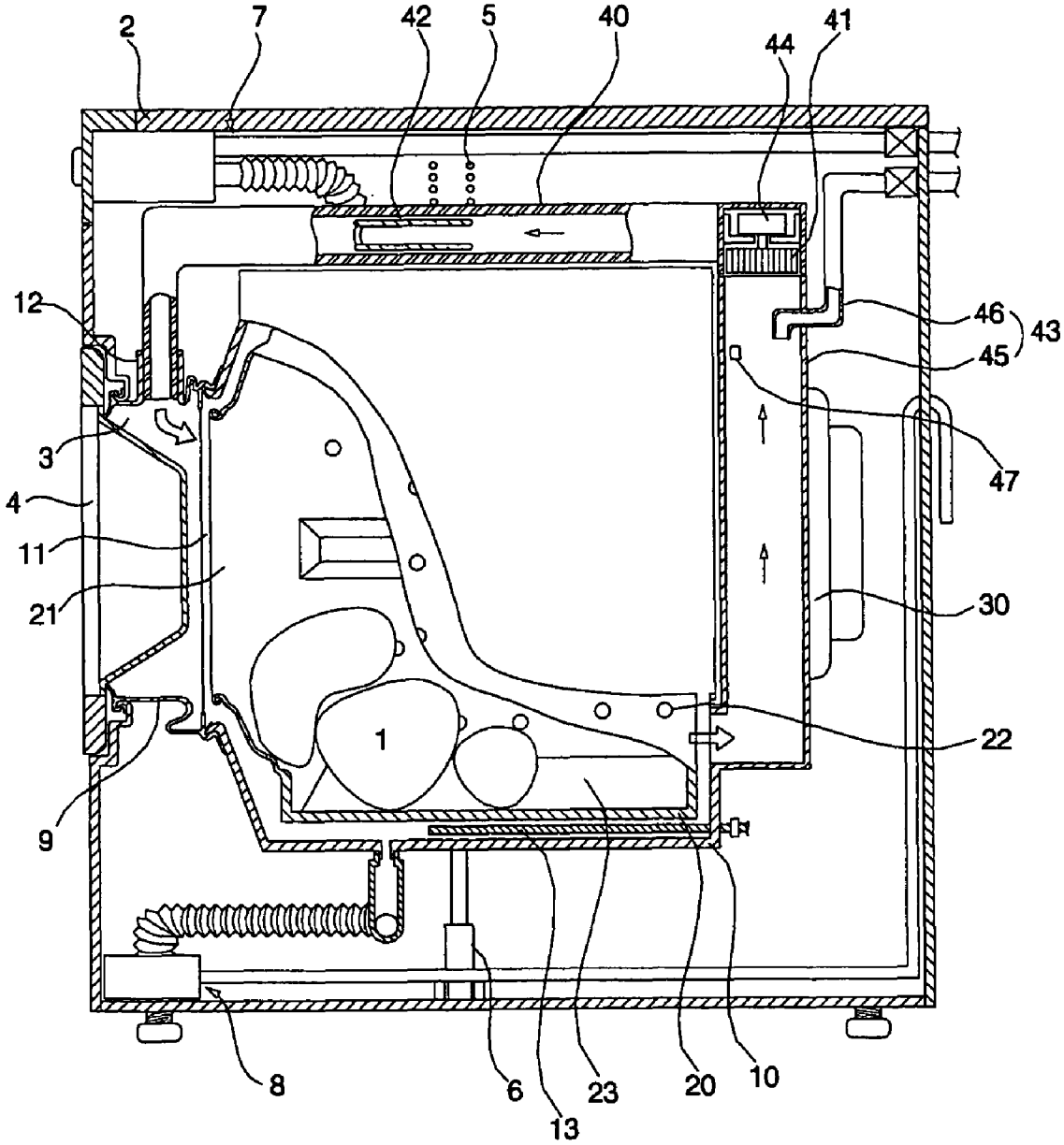
FIG. 1 (Prior Art)
FIG. 1 is a cross sectional view, partially cutaway, illustrating the interior of a conventional washing and drying machine.
Figure 2:
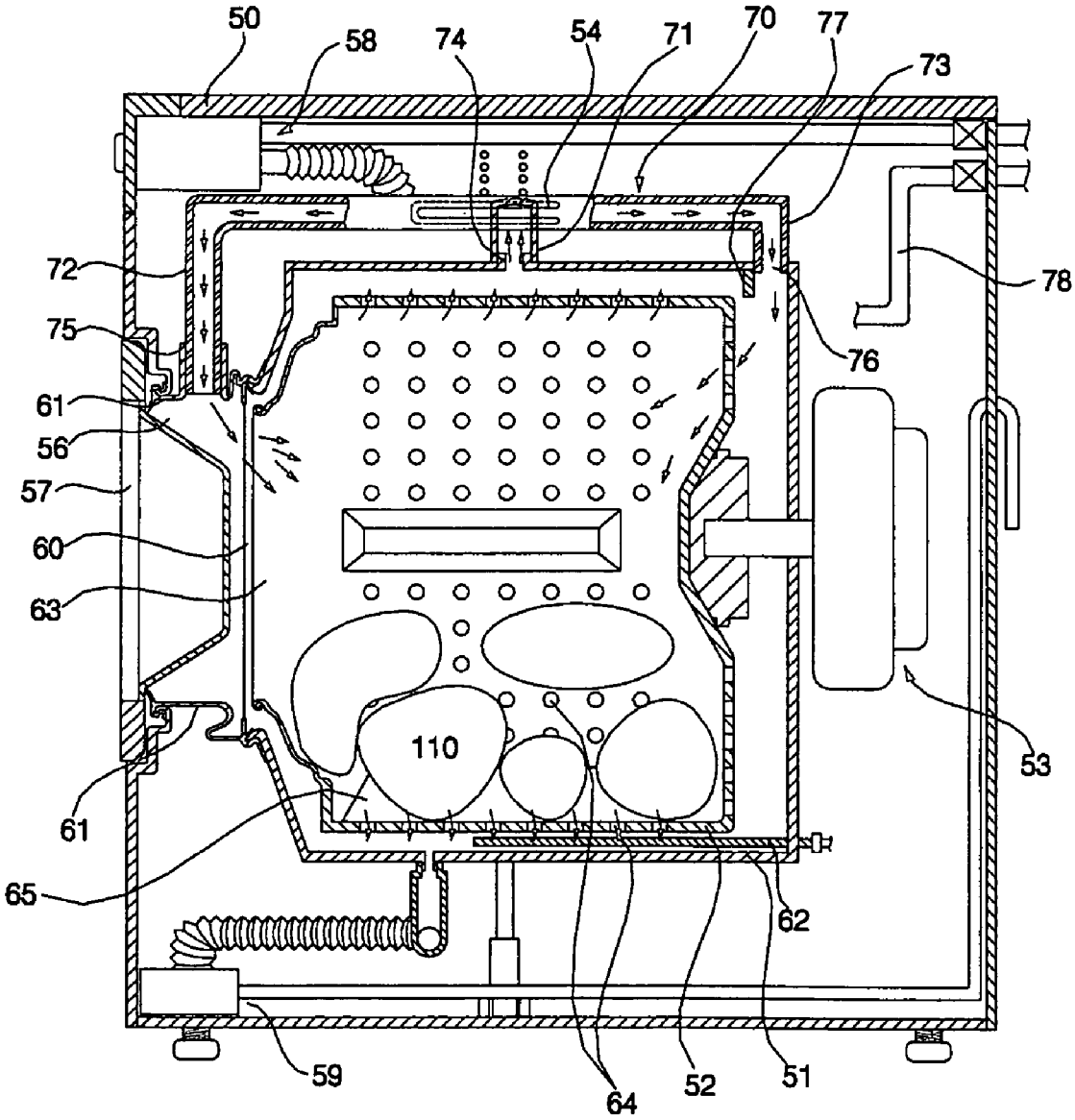
FIG. 2 is a cross sectional view illustrating the interior of a washing and drying machine according to a first embodiment of the present invention.
Figure 3:
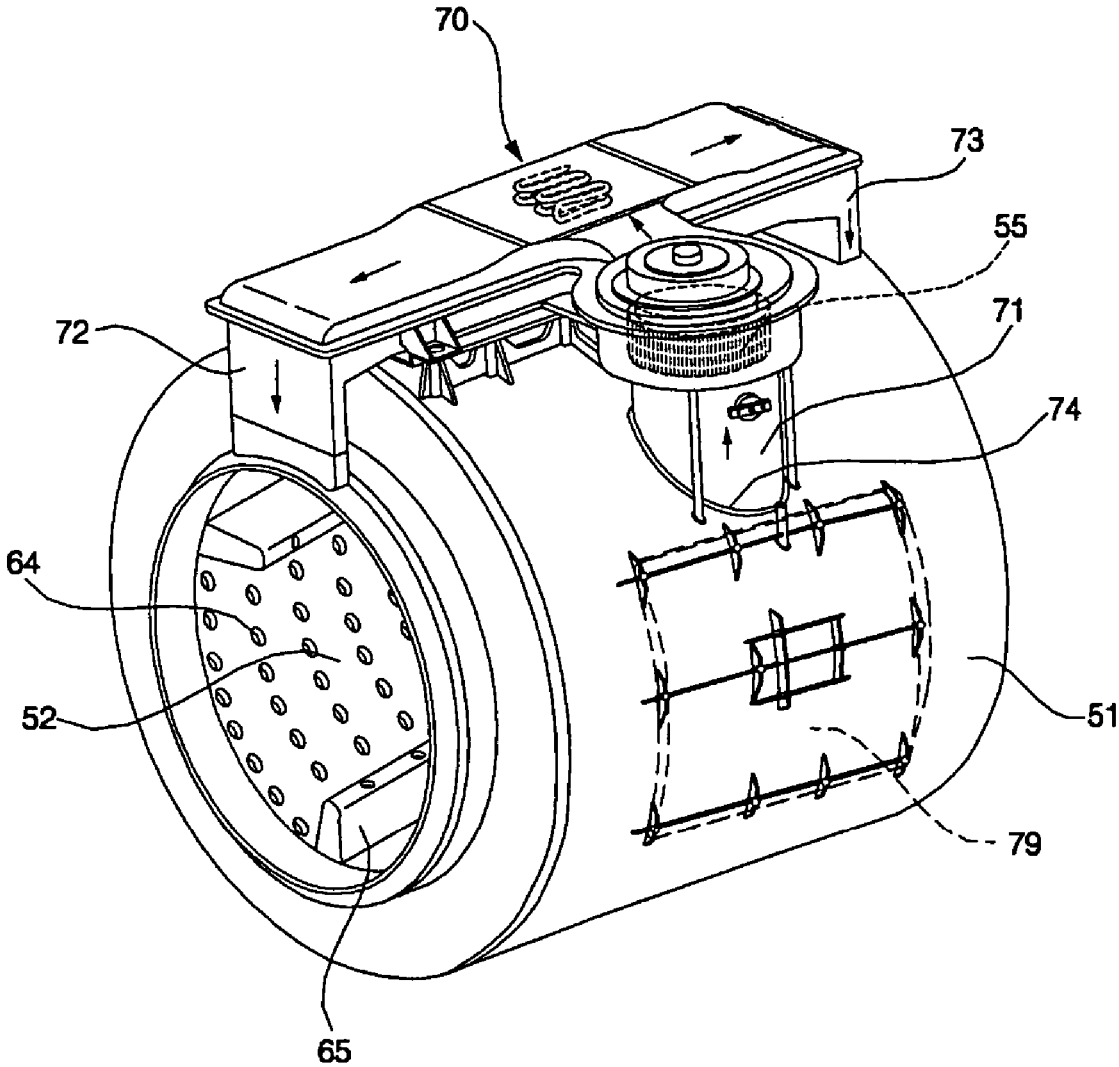
FIG. 3 is a perspective view illustrating a tub of the washing and drying machine according to the first embodiment of the present invention.
Figure 4:
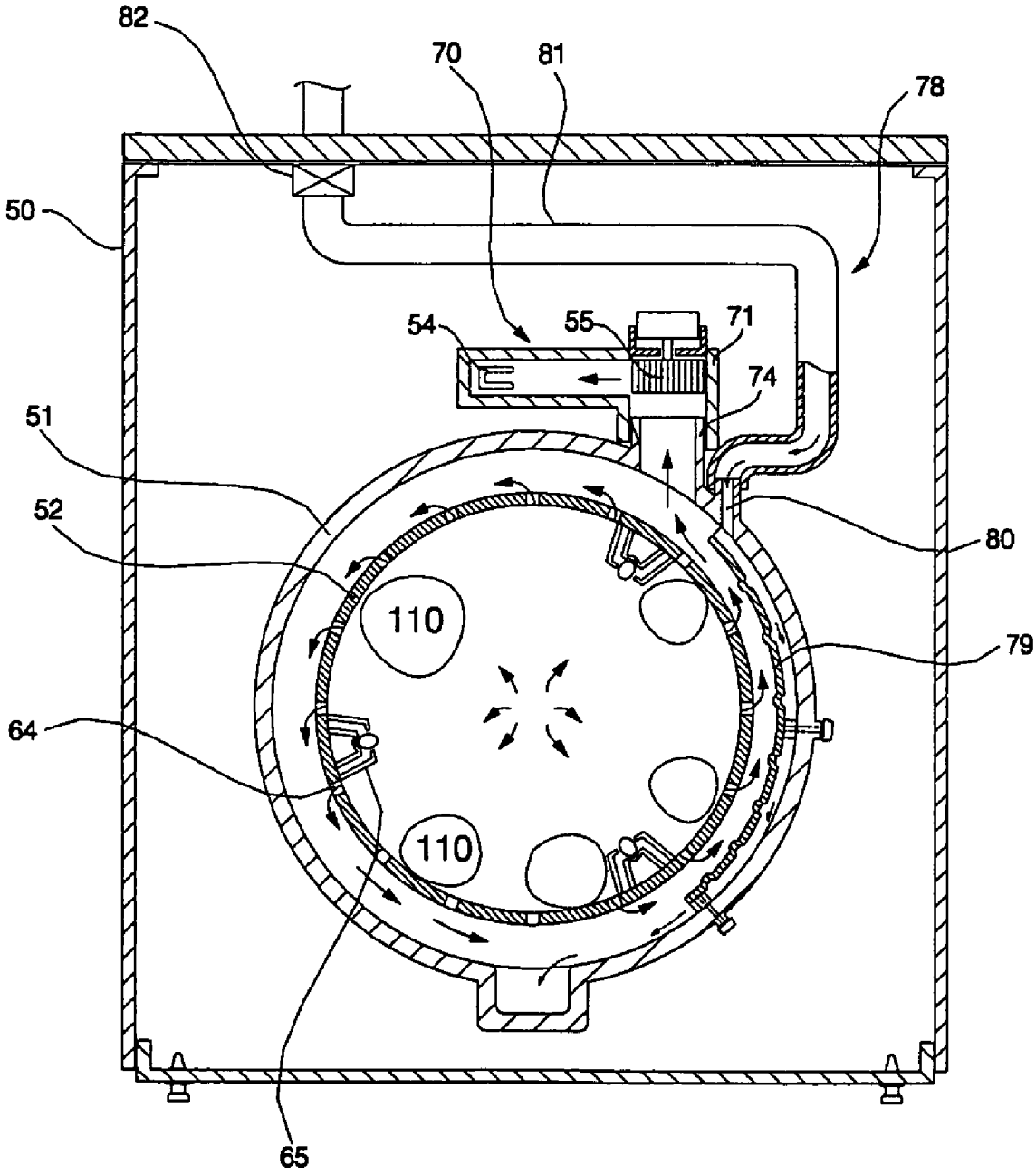
FIG. 4 is a cross-sectional view illustrating the interior of the washing and drying machine according to the first embodiment of the present invention.

FIG. 2 is a cross sectional view illustrating the interior of a washing and drying machine according to a first embodiment of the present invention, FIG. 3 is a perspective view illustrating a tub of the washing and drying machine according to the first embodiment of the present invention, and FIG. 4 is a cross-sectional view illustrating the interior of the washing and drying machine according to the first embodiment of the present invention.

As shown in FIGS. 2 to 4, the washing and drying machine according to the first embodiment of the present invention includes a cabinet 50; a tub 51 mounted in the cabinet 50 in a supported manner for receiving washing water; a drum 52 rotatably disposed in the tub 51 for receiving laundry 110; a motor 53 for rotating the drum 52; and a drying duct 70, having a drying heater 54 and a blowing fan 55 mounted therein, for supplying hot air into the drum 52.

At the front surface of the cabinet 50 is formed a laundry inlet/outlet hole 56, through which the laundry 110 is placed into or removed from the drum 52. To the front surface of the cabinet 50 is also pivotably attached a door 57 for opening or closing the laundry inlet/outlet hole 56.

To the tub 51 is connected a water supply unit 58 for supplying washing water into the tub 51 from the outside of the washing machine. To the tub 51 is also connected a drainage unit 59 for draining the washing water out of the tub 51.

At the center portion of the front surface of the tub 51 is formed a tub opening hole 60, through which the laundry 110 and air are introduced into or discharged from the tub 51. To the front surface of the tub 51 is attached a gasket 61, which comes into tight contact with the door 57, when the door 57 is closed, for preventing the laundry 110, the washing water, and the air from being discharged from a gap between the tub 51 and the door 57.

At the inner bottom surface of the tub 51 is mounted a washing heater 62 for heating the washing water such that the laundry can be washed with hot water. At the inner bottom surface of the tub 51 is also mounted a washing temperature sensor (not shown) for detecting the temperature of the washing water.

At the front surface of the drum 52 is formed a drum opening hole 63, through which the laundry 110 and air are introduced into or discharged from the drum 52. At the circumferential surface and the rear surface of the drum 52 are formed a plurality of through-holes 64, through which washing water and air are introduced into or discharged from the drum 52. To the inner wall of the drum 52 are attached a plurality of lifters 65, by which the laundry 110 is lifted and then falls.

The drying duct 70 includes an inlet end 71 for introducing air from the drum 52; and outlet ends 72 and 73 for heating the air introduced through the inlet end 71 and discharging the heated air into the drum 52.

At least one inlet end 71 and at least two outlet ends 72 and 73 may be provided. In the following description, only one inlet end 71 and only two outlet ends 72 and 73 are provided to form the drying duct 70.

The inlet end 71 of the drying duct 70 is connected to an inlet end connection member 74 formed at a predetermined position of the upper part of the circumferential surface of the tub 51. Preferably, the inlet end connection member 74 is formed at the tub 51 in a substantially tangential direction such that resistance of air introduced through the inlet end 71 is minimized.

The outlet ends 72 and 73 diverge from the inlet end 71 to the front and the rear of the inlet end 71, and are connected to the front and rear sides of the tub 51, respectively, for discharging hot air into the drum 52.

Specifically, the outlet ends 72 and 73 include a front outlet end 72 connected to the front side of the tub 51 for discharging hot air into the tub 51 at the front side of the tub 51; and a rear outlet end 73 connected to the rear side of the tub 51 for discharging hot air into the tub 51 at the rear side of the tub 51.

The front outlet end 72 is fixedly inserted into or fitted onto a front connection member 75 formed at the gasket 61, and the rear outlet end 73 is fixedly connected to a rear connection member 76 formed at the rear portion of the upper side of the tub 51.

Between the tub 51 and the drum 52 is provided a blocking wall 77 for preventing hot air discharged through the rear outlet end 73 of the drying duct 70 from flowing between the inner circumferential surface of the tub 51 and the outer circumferential surface of the drum 52.

The blocking wall 77 extends downward from the inner wall of the tub 51.

Preferably, the blowing fan 55 is provided upstream of the drying heater 54 such that the air can be introduced into the drying duct 70 from the drum 52. Also preferably, the blowing fan 55 is provided upstream of a diverging point, from which the front outlet end 72 and the rear outlet end 73 diverge. In the following description, the blowing fan 55 is provided at the inlet end side.

Specifically, the blowing fan 55 is positioned right above the inlet end connection member 74.

Also, the drying heater 54 is positioned between the blowing fan 55 and the diverging point, from which the front outlet end 72 and the rear outlet end 73 diverge, such that not only air flowing through the front outlet end 72 but also air flowing through the rear outlet end 73 is heated by the drying heater 54.

The drying heater 54 may be positioned at the diverging point, from which the front outlet end 72 and the rear outlet end 73 diverge, or may be positioned upstream of the diverging point, from which the front outlet end 72 and the rear outlet end 73 diverge. In the following description, the drying heater 54 is positioned at the diverging point, from which the front outlet end 72 and the rear outlet end 73 diverge.

As shown in FIGS. 3 and 4, the washing and drying machine further includes a condenser for condensing air used to dry the laundry 110 in the tub 51.

The condenser includes a cooling water supply unit 78 for supplying cooling water to one side of the tub 51; and a condensing plate 79 mounted at the inner wall of the tub 51 for guiding the cooling water supplied from the cooling water supply unit 78 such that the cooling water flows between the inner wall of the tub 51 and the condensing plate 79.

The tub 51 is provided at one side thereof with a cooling water supplying hole 80, through which the cooling water supplied from the cooling water supply unit 78 is introduced into the tub 51.

As shown in FIG. 4, the cooling water supply unit 78 includes a cooling water hose 81 for guiding cooling water supplied from the outside of the washing machine to the cooling water supplying hole 80; and a cooling water valve 82 mounted on the cooling water hose 81 for allowing the water to flow to the cooling water supplying hole 80 through the cooling water hose 81 or interrupting the water from flowing to the cooling water supplying hole 80 through the cooling water hose 81.

The condensing plate 79 is positioned below the inlet end connection member 74 and the cooling water supplying hole 80. As shown in FIG. 3, the condensing plate has a predetermined width extending between the rear side of the tub 51 and the front side of the tub 51 about the inlet end connection member 74.

A drying process of the washing and drying machine with the above-stated construction according to the first embodiment of the present invention will now be described.

When the drying process is performed to dry the laundry 110, the drum 52 is rotated, and the blowing fan 55 and the drying heater 54 are turned on. Also, the cooling water is supplied from the cooling water supply unit 78.

As the drum 52 is rotated, the laundry 110 is shaken and tossed in the drum 52. At this time, air in the drum 52 flows toward the through-holes 64 of the drum 52 by blowing force generated when the blowing fan 55 is rotated.

The air flowing toward the through-holes 64 of the drum 52 comes into contact with the laundry 110. As a result, the air is changed into low-temperature and high-humidity air, which flows between the drum 52 and the tub 51 through the through-holes 64 of the drum 52.

The low-temperature and high-humidity air, i.e., the wet air, flowing between the drum 52 and the tub 51 comes into contact with the condensing plate 79.

At this time, the cooling water supplied through the cooling water valve 82 and the cooling water hose 81 passes between the condensing plate 79 and the inner wall of the tub 51 to absorb heat from the condensing plate 79, and is then discharged downward.

As a result, heat of the wet air is transmitted to the condensing plate 79. Consequently, the moisture in the wet air is condensed by the condensing plate 79, and therefore, the wet air is changed into low-humidity air.

The low-humidity air is introduced into the inlet end 71 of the drying duct 70 through the inlet end connection member 74, and is then heated by the drying heater 54. As a result, the low-humidity air is changed into hot air having high temperature and low humidity.

The hot air flows through the front outlet end 72 and the rear outlet end 73 of the drying duct 70 such that the hot air is discharged into the tub 51 at the front and rear sides of the tub 51, respectively.

Specifically, some of the hot air is discharged into the tub 51 at the front side of the tub 51 through the front outlet end 72, and the remainder of the hot air is discharged into the tub 51 at the rear side of the tub 51 through the rear outlet end 73.

Consequently, hot air is supplied into the drum 52 at the front and rear sides of the drum 52, and therefore, the laundry 110 is uniformly dried without regard to where the laundry 110 is placed.

Further, the blocking wall 77 is mounted in the tub 51 at the rear side of the tub 51. Consequently, the hot air discharged through the outlet end 73 of the drying duct 70 is prevented from flowing between the inner circumferential surface of the tub 51 and the outer circumferential surface of the drum 52, and therefore, effective flow rate of the hot air discharged into the drum 52 through the through-holes 64 of the drum 52 is increased.

Figure 5:
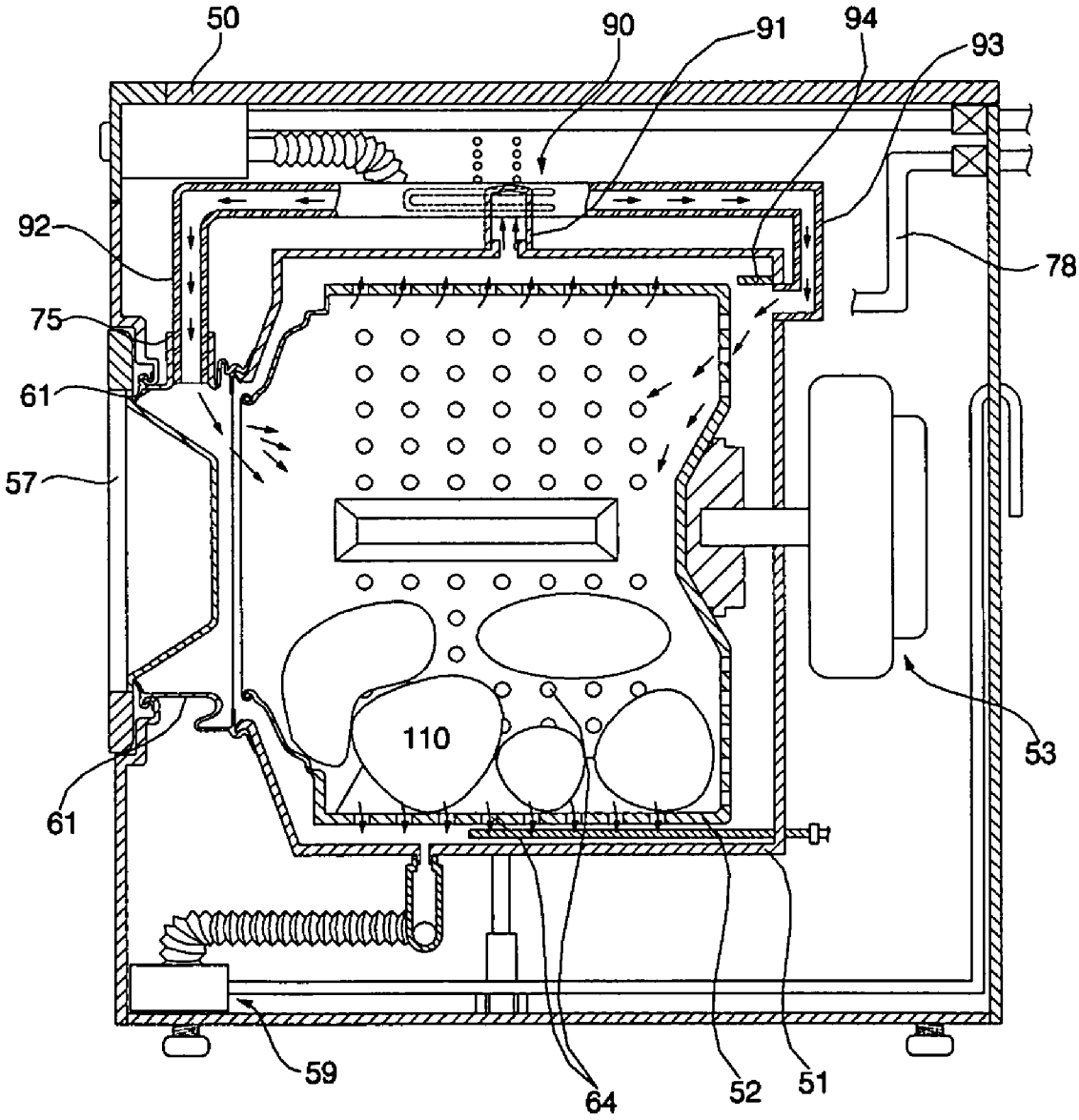
FIG. 5 is a cross sectional view illustrating the interior of a washing and drying machine according to a second embodiment of the present invention.

FIG. 5 is a cross sectional view illustrating the interior of a washing and drying machine according to a second embodiment of the present invention.

The washing and drying machine according to the second embodiment of the present invention includes a drying duct 90. As shown in FIG. 5, the drying duct 90 includes an inlet end 91 for introducing air from the drum 52; and outlet ends 92 and 93 for heating the air introduced through the inlet end 91 and discharging the heated air into the drum 52. The outlet ends 92 and 93 include a front outlet end 92 connected to the front side of the tub 51 for discharging hot air into the tub 51 at the front side of the tub 51; and a rear outlet end 93 connected to the rear side of the tub 51 for discharging hot air into the tub 51 at the rear side of the tub 51.

The washing and drying machine according to the second embodiment of the present invention is identical in construction and operation to the washing and drying machine according to the first embodiment of the present invention except that the rear outlet end 93 is connected to the upper part of the rear surface of the tub 51, and a blocking wall 94, which is provided to prevent hot air discharged through the rear outlet end 93 from flowing between the inner circumferential surface of the tub 51 and the outer circumferential surface of the drum 52, extends forward from the inside rear wall of the tub 51.

Therefore, components of the washing and drying machine according to the second embodiment of the present invention, which are identical to those of the washing and drying machine according to the first embodiment of the present invention, are indicated by the same reference numerals as those of the washing and drying machine according to the first embodiment of the present invention, and a detailed description thereof will not be given.

Preferably, the part of the rear outlet end 93 provided at the rear side of the tub 51 has a smaller cross sectional area and length than those of other parts of the rear outlet end 93 such that the rear outlet end 93 minimally occupies the space between the rear surface of the tub 51 and the cabinet 50, and flow resistance is minimized.

According to the washing and drying machine according to the second embodiment of the present invention, the hot air discharged through the rear outlet end 93 flows toward the rear surface of the drum 52. Consequently, the hot air is more easily supplied into the drum 52.

Figure 6:
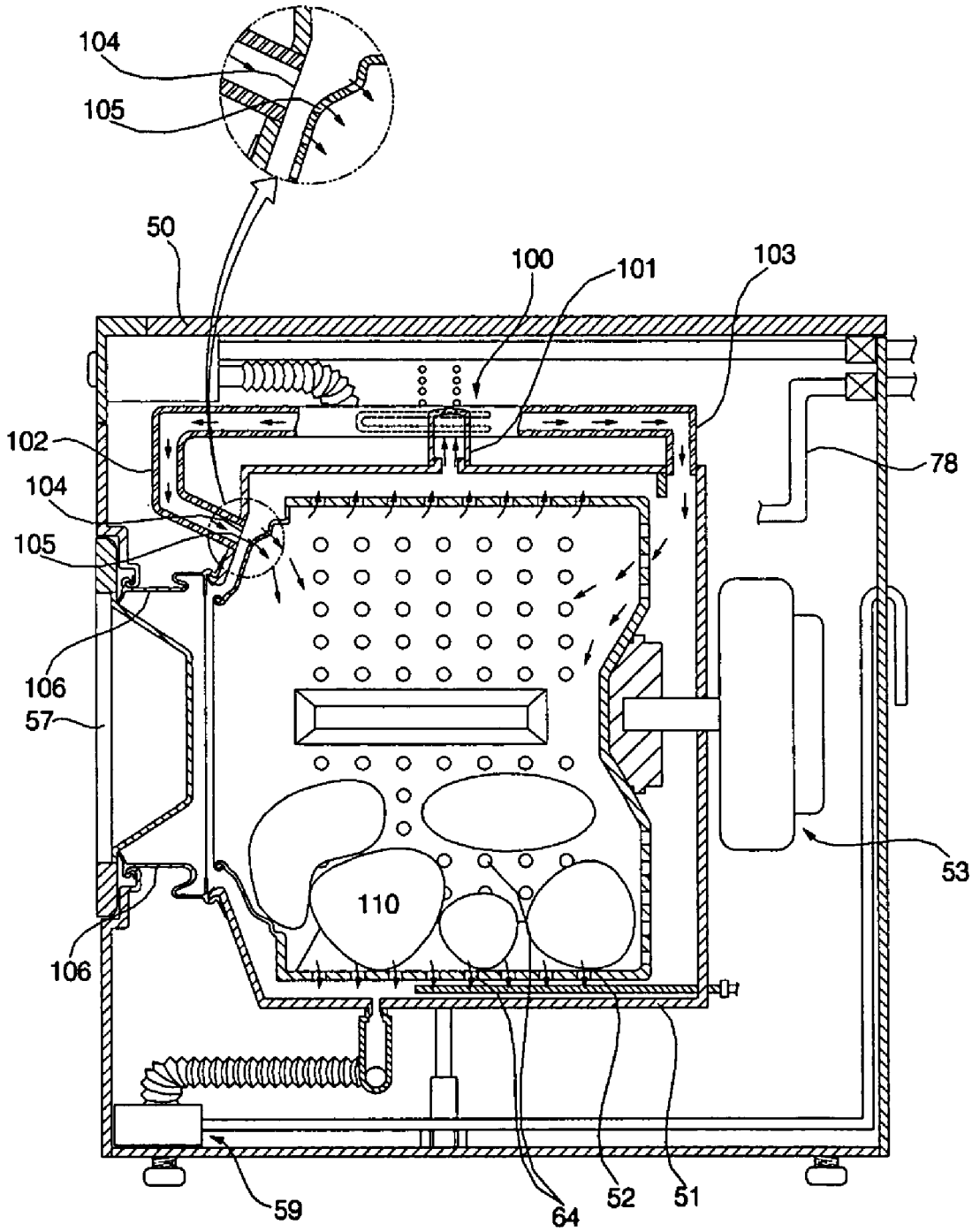
FIG. 6 is a cross sectional view illustrating the interior of a washing and drying machine according to a third embodiment of the present invention.

FIG. 6 is a longitudinal cross sectional view illustrating the interior of a washing and drying machine according to a third embodiment of the present invention.

The washing and drying machine according to the third embodiment of the present invention includes a drying duct 100. As shown in FIG. 6, the drying duct 100 includes an inlet end 101 for introducing air from the drum 52; and outlet ends 102 and 103 for heating the air introduced through the inlet end 101 and discharging the heated air into the drum 52. The outlet ends 102 and 103 include a front outlet end 102 connected to the front side of the tub 51 for discharging hot air into the tub 51 at the front side of the tub 51; and a rear outlet end 103 connected to the rear side of the tub 51 for discharging hot air into the tub 51 at the rear side of the tub 51.

The washing and drying machine according to the third embodiment of the present invention is identical in construction and operation to the washing and drying machine according to the first embodiment of the present invention except that the front outlet end 102 is directly connected to a front connection member 104 formed at the upper part of the front surface of the tub 51, the drum 52 has a plurality of through-holes 105, which are positioned opposite to the front connection member 104.

Therefore, components of the washing and drying machine according to the third embodiment of the present invention, which are identical to those of the washing and drying machine according to the first embodiment of the present invention, are indicated by the same reference numerals as those of the washing and drying machine according to the first embodiment of the present invention, and a detailed description thereof will not be given.

According to the washing and drying machine according to the third embodiment of the present invention, the front outlet end 102 is directly connected to the tub 51. Consequently, damage to a gasket 106 caused when the hot air passes through the gasket 106 is prevented, and therefore, decrease in service life of the gasket 106 is prevented.

As apparent from the above description, the washing and drying machine according to the present invention has the following effects.

The drying duct has at least one inlet end and at least two outlet ends. Consequently, air flow is increased, and therefore, drying time and power consumption are reduced.

Furthermore, the inlet end is connected to the center portion of the circumferential surface of the tub, and the outlet ends include a front outlet end connected to the front side of the tub and a rear outlet end connected to the rear side of the tub. Consequently, the laundry is uniformly dried even when the laundry is placed in the drum at the front and/or the rear sides of the drum, and therefore, damage to the laundry is prevented. Also, air flow sufficient to dry the laundry is obtained, and flow resistance is minimized. Consequently, drying time and power consumption are reduced.

In addition, the blocking wall is provided between the tub and the drum for preventing hot air discharged through the rear outlet end from flowing between the inner circumferential surface of the tub and the outer circumferential surface of the drum. Consequently, effective flow rate of the hot air discharged into the drum is increased.

Moreover, the front outlet end is directly connected to the upper part of the front surface of the tub. As a result, the hot air does not pass through the gasket. Consequently, damage to the gasket is prevented, and therefore, decrease in service life of the gasket is prevented.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A washing and drying machine comprising:

a tub provided in a cabinet in a supported manner; a drum rotatably provided inside said tub; and a drying duct, having a drying heater and a blowing fan mounted therein, said drying duct supplying hot air into said drum, said drying duct including at least two outlet ends to discharge the hot air into said drum, wherein said drying duct includes a single inlet end connected to the circumferential surface of the tub to introduce air from the drum into the drying duct, the single inlet end being positioned substantially at a center of the circumferential surface of the tub, and wherein said at least two outlet ends diverge in an axial direction of said tub from said inlet end to the front and the rear of said inlet end, and are connected to the front and rear sides of said tub, respectively.

2. The machine as set forth in claim 1, wherein said at least two outlet ends comprise:

a front outlet end to discharge the hot air into said tub at the front side of said tub; and a rear outlet end to discharge the hot air into said tub at the rear side of said tub.

3. The machine as set forth in claim 2, further comprising:

a door to open or close a laundry inlet/outlet hole formed in the cabinet; and a gasket attached to said tub to maintain a seal between the door and said tub, wherein said front outlet end is connected to said gasket.

4. The machine as set forth in claim 2, wherein said rear outlet end is connected to the rear portion of the upper side of said tub.

5. The machine as set forth in claim 2, further comprising:

a blocking wall provided between said tub and said drum to prevent the hot air discharged through the rear outlet end from flowing between the circumferential surface of said tub and the circumferential surface of said drum.

6. The machine as set forth in claim 5, further comprising:

a condenser to condense moisture in the air in said tub.

7. The machine as set forth in claim 6, wherein said condenser comprises:

a cooling water supply unit to supply cooling water to one side of said tub; and a condensing plate mounted at the inner wall of said tub to guide the cooling water supplied from said cooling water supply unit such that the cooling water flows between the inner wall of said tub and said condensing plate.

8. The machine as set forth in claim 1, wherein said blowing fan is provided upstream of a diverging point, from which said at least two outlet ends diverge.

9. The machine as set forth in claim 8, wherein said drying heater is provided between said blowing fan and the diverging point.

10. The machine as set forth in claim 1, wherein the front and rear outlet ends and the inlet end form a T shape.

11. A washing and drying machine comprising:

a tub provided in a cabinet in a supported manner;

a drum rotatably provided inside said tub;

a drying duct, having a drying heater and a blowing fan mounted therein, said drying duct supplying hot air into said drum; and a condenser to condense moisture in the air in said tub, wherein said drying duct is provided with a single inlet end positioned substantially at a center of the circumferential surface of said tub to introduce air from the drum into the drying duct and at least two outlet ends to discharge the hot air into said drum wherein said at least two outlet ends diverge in an axial direction of said tub from the inlet end to the front and the rear of the inlet end, and are connected to the front and rear sides of said tub, respectively, wherein an inlet end connection member is formed at the circumferential surface of the tub in a tangential direction of the tub, and the single inlet end is connected to the inlet end connection member.

12. The machine as set forth in claim 11, wherein said condenser comprises:

a cooling water supply unit to supply cooling water to one side of said tub; and a condensing plate disposed inside said tub to guide the cooling water supplied from said cooling water supply unit such that the cooling water flows between an inner circumferential surface of said tub and said condensing plate, the condensing plate being spaced inward from the inner circumferential surface of said tub by a predetermined distance.

13. A washing and drying machine comprising:

a tub provided in a cabinet in a supported manner;

a drum rotatably provided inside said tub;

a drying duct, having a drying heater therein, said drying duct supplying hot air into said drum; and a condenser to condense moisture in the air in said tub, wherein said drying duct comprises:

a single inlet end connected to the circumferential surface of said tub to introduce air from said drum into the drying duct, the inlet end being positioned substantially at the center portion of the circumferential surface of the tub;

a front outlet end connected to the front side of said tub to discharge the hot air into said tub at the front side of said tub; and a rear outlet end connected to the rear side of said tub to discharge the hot air into said tub at the rear side of said tub, wherein the front and rear outlet ends diverge in an axial direction of said tub from the single inlet end to the front and rear outlet ends, and a single blowing fan is provided upstream of the single inlet end from which the front and rear outlet ends are diverged.

14. The machine as set forth in claim 13, wherein the front and rear outlet ends diverge from the inlet end in an axial direction of the tub.

* * * * *